US006984343B1

(12) United States Patent
Wen et al.

(10) Patent No.: US 6,984,343 B1
(45) Date of Patent: Jan. 10, 2006

(54) FLUID SUSPENSIONS WITH ELECTRORHEOLOGICAL EFFECT

(75) Inventors: Weijia Wen, Kowloon (HK); Ping Sheng, Kowloon (HK); Shihe Yang, Kowloon (HK)

(73) Assignee: China Patent Investment Limited, Central (HK)

( * ) Notice: Subject to any disclaimer, the term of this patent is extended or adjusted under 35 U.S.C. 154(b) by 0 days.

(21) Appl. No.: 10/876,586

(22) Filed: Jun. 28, 2004

(51) Int. Cl.
*H01B 1/08* (2006.01)

(52) U.S. Cl. ..... 252/518.1

(58) Field of Classification Search ..... 252/73, 252/500, 512, 518.1
See application file for complete search history.

(56) References Cited

U.S. PATENT DOCUMENTS

2004/0051076 A1 3/2004 Sheng et al.

*Primary Examiner*—John R. Hardee
(74) *Attorney, Agent, or Firm*—Buchanan Ingersoll PC

(57) ABSTRACT

There is described an electrorheological fluid comprising coated nanoparticle suspended in an electrically insulated hydrophobic liquid. The core particles consist of $TiO_2$ or metal salts of the form $M1_xM2_{2-2x}TiO(C_2O_4)_2$ where M1 is selected from the group consisting of Ba, Sr and Ca and wherein M2 is selected from the group consisting of Rb, Li, Na and K. The particle shell is made of highly polar molecules selected from the group consisting of thiourea and urea.

12 Claims, 6 Drawing Sheets

FLUID SUSPENSIONS WITH ELECTRORHEOLOGICAL EFFECT

FIELD OF THE INVENTION

This invention relates to electrorheological fluids formed of particles in suspension, and in particular to such a fluid having an improved yield stress.

BACKGROUND OF THE INVENTION

Electrorheological fluids are colloidal suspensions whose electrorheological properties can be varied through the application of an external electric field. In particular, under the application of a field of the order of 1–2 kV/mm, an electrorheological fluid can exhibit a solid-like behavior, such as the ability to transmit shear stress. This transformation from liquid-like to solid-like behavior can be very fast, of the order of 1 to 10 ms, and is reversible when the electric field is removed.

Electrorheological fluids are of interest because potentially they can provide simple, quiet, and fast interfaces between electrical controls and mechanical systems. As such, they have a number of potential applications including automotive clutches, ABS brakes, shock absorption, vibration damping and micro-electric mechanical systems.

Most previous electrorheological fluids are based on the usage of micron-sized particles and on the large dielectric contrast between the particles and the fluid. A problem of this prior art is that the yield strength is too low for many practical applications, which results from large currents and breakdown. The yield strength of these electrorheological fluids is typically no more than 3 kPa at 1 kV/mm. The yield stress of the nanoparticle-based electrorheological fluids reaches up to 40 kPa when suitable promoters are added (U.S. patent application Ser. No. 10/243,668). However, there is much room for improvement of the performance of the electrorheological fluids by varying the parameters of the material components and the synthesis procedures.

SUMMARY OF THE INVENTION

According to the present invention, there is provided an electrorheological fluid containing nanoparticles having an inorganic core coated with a polar compound and an electrically insulating hydrophobic liquid, where the core is $TiO_2$ or an amorphous salt of the form $M1_xM2_{2-2x}TiO(C_2O_4)_2$ where M1 is selected from the group consisting of Ba, Sr and Ca and wherein M2 is selected from the group consisting of Rb; Li, Na and K.

The particles are coated with a highly polar molecule preferably having a molecular dipole of greater than 1.9 Debye. Examples of preferred coating materials include acetamide, urea and thiourea.

Viewed from another broad aspect the present invention also provides an electrorheological system comprising, an electrorheological fluid comprising coated particles suspended in an electrically insulating hydrophobic liquid, selected from the group consisting of silicone oil, mineral oil, engine oil, and hydrocarbon oil, preferably with viscosity ranging from 10 to 200 cP. The inorganic core may be made of $TiO_2$ or metal salts of the form $M1_xM2_{2-2x}TiO(C_2O_4)_2$. M1 may be selected from the group consisting of Ba, Sr and Ca and wherein M2 may be selected from the group consisting of Cs, Rb, Li, Na and K. The coating is preferably composed of the highly polar molecules selected from the group consisting of acetamide, thiourea and urea.

In a preferred embodiment the coated particle is mixed with a hydrophobic liquid, preferably silicone oil, mineral oil, engine oil and hydrocarbon oil in a volume fraction of 0.5% to 50%, with respect to the hydrophobic liquid.

The system may further include a means for applying to the electrorheological fluid a DC electric field or an AC electric field with a frequency of less than 1000 Hz.

Viewed from a still-further aspect the present invention provides a method of manufacturing coated particles for an electrorheological fluid comprising first preparing solid core particles by hydrothermal and sol-gel methods, and fabricating a coating using highly polar molecules selected from the group consisting of acetamide, thiourea, urea, and a mixture of polar solvents selected from the group of water, alcohol, and acetone.

BRIEF DESCRIPTION OF THE DRAWINGS

Some embodiments of the invention will now be described by way of example and will be referenced to the accompanying drawings, in which:—

FIG. 5(*b*) shows the current density of electrorheological fluids as a function of the applied electric field strength.

FIG. 6(*b*) shows the measured current density of silicone oil based electrorheological fluids as a function of the applied electric field strength.

FIG. 7(*b*) shows the measured current density as a function of applied electric field strength.

FIG. 8(*b*) shows the measured yield stress as a function of the frequency (of the applied electric field) and hydrocarbon oil based electrorheological fluids.

DETAILED DESCRIPTION OF PREFERRED EMBODIMENTS

Figure 1:
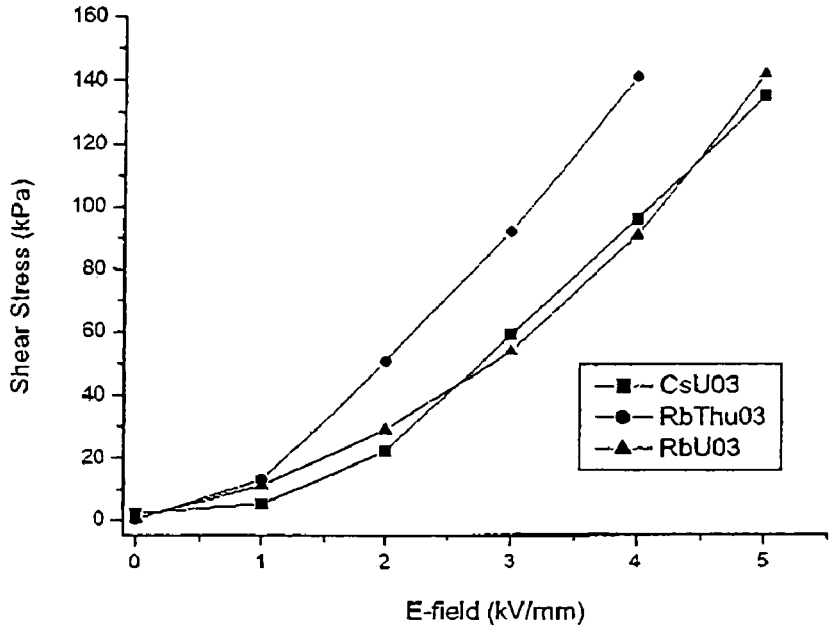
FIG. 1 shows the measured shear stress as a function of applied electric field strength using the coated particles of an embodiment of this invention and silicone oil.

The fabrication of the nanoparticles containing an inorganic core with an outer layer of a material having a large molecular dipole for use in embodiments of the invention will now be described by way of example.

For ease of reference the following nomenclature will be used.

$CsU=Ba_xCs_{2-2x}TiO(C_2O_4)_2$ coated with urea.

$RbU=Ba_xRb_{2-2x}TiO(C_2O_4)2$ coated with urea.

$RbThu=Ba_xRb_{2-2x}TiO(C_2O_4)_2$ coated with thiourea $TiO_2Thu=TiO_2$ coated with thiourea.

X is between 0.94 and 0.96.

The samples CsU, RbThu and $TiO_2Thu$ were prepared from the following chemicals: (1). Barium Chloride Dihydrate (BC), Titanium Tetrachloride (TT), Cesium Chloride (CC), Rubidium Chloride (RC), Oxalic Acid Dihydrate (OA), Thiourea (Thu), and Urea (U).

METHOD 1—Preparation of $Ba_xRb_{2-2x}TiO(C_2O_4)2$ coated with thiourea (RbThu)

1. In a large beaker containing 300 ml of TT solution, 150 ml BC solution and 75 ml RC solution are added. The mixture should be stirred until it becomes milky.
2. Thu (105 ml) is slowly added to the mixture of step 1 while stirring constantly maintaining the temperature at between 25° C.–80° C. White powders will then form rapidly and precipitate out of the solution.
3. The beaker is immersed into a cold water bath immediately to cool down the solution to room temperature.
4. After cooling the solution, the solution is decanted and the powder is washed several times with water. Filter paper and filter funnel are used to filter out the white powder.
5. After drying at between 30° C.–150° C., the powder is ready for the preparation of electrorheological-fluids.

METHOD 2—Preparation of $Ba_xRb_{2-2x}TiO(C_2O_4)_2$ coated with urea (RbU)

1. In a large beaker containing 300 ml of TT solution, 150 ml of BC solution and 75 ml of RC solution The mixture should be stirred until it becomes milky.
2. U is slowly added to the mixture of step 1 while stirring constantly maintaining the temperature at between 25° C.–80° C. White powders will then form rapidly and precipitate out of the solution.
3. The beaker is immersed into a cold water bath immediately to cool down the solution to room temperature.
4. After cooling the solution, the solution is decanted and the powder is washed several times with water. Filter paper and filter funnel are used to filter out the white powder.
5. After drying at between 30° C.–150° C., the powder is ready for the preparation of electrorheological-fluids.

METHOD 3—Preparation of $Ba_xRb_{2-2x}TiO(C_2O_4)2$ coated with urea (CsU)

1. In a large beaker containing 300 ml of TT solution 150 ml of BC solution and 75 ml of CC solution. The mixture should be stirred until it becomes milky.
2. U is slowly added to the mixture of step 1 while stirring constantly maintaining the temperature at between 25° C.–80° C. White powders will then form rapidly and precipitate out of the solution.
3. The beaker is immersed into a cold water bath immediately to cool down the solution to room temperature.
4. After cooling the solution, the solution is decanted and the powder is washed several times with water. Filter paper and filter funnel are used to filter out the white powder.
5. After drying at between 30° C. –150° C., the powder is ready for the preparation of electrorheological-fluids.

METHOD 4—Preparation of $T_1O_2Thu$ 1. 75 ml of Ti(iso-$OC_3H_7$) is dissolved in $90M^1$ of iso-$C_3H_7OH$ of room temperature.
2. The solution of 1 (164 ml) is then added dropwise to a solution HCl (200 ml) with a format pH2. The reaction is conducted at room temperature, and results in a light brown precipitate.
3. Afterwards, it was neutralized with 0.1NaOH(15 m) under magnetic stirring.
4. After filtration and freeze drying, white powder is obtained.
5. Mix the white powder with a solution of either urea or thiourea
6. The solution is decanted and the powder is washed several times with water. Filter paper and filter funnel are used to filter out the white powder.
7. After drying, the powder is ready for the preparation of electrorheological-fluids.

Particles made in accordance with Methods 1–4 are mixed with silicone oil in a volume fraction between 5% and 50% (preferably 10% to 35%), to form electrorheological fluids. Other possible oils that may be used include mineral oils, engine oils, such as one-shell, Danax and TA and hydrocarbon oils. The oil may have a viscosity ranging from 10 to 200 cP.

The electrorheological fluids were then characterized using a cell formed of two parallel electrodes. The dielectric measurements were carried out with a I-IP4192A LF impedance analyzer, while the electrorheological properties were measured by a plate/plate viscometer (Haake RS 1) with a gap width of 1 mm. The experimental data was collected by using Rheowin software.

It should be noted that at the very low shear rate of 0.1 $sec^{-1}$, the measured shear stress is almost equal to the yield stress.

In the Figures "03" as in $CsUO_3$ means a concentration obtained by mixing 1 gram of the particles in 0.3 ml of the (silicone or HC) oil and "07" as in CsU07 means a concentration obtained by mixing 1 gram of the particles in 0.7 ml of the oil.

The coating materials utilized in preparation of the coated nanoparticle are chosen to have a high molecular dipole. This high molecular dipole surprisingly produces a strong electrorheological effect at the same current densities compared to other electrorheological fluids. Materials with a dipole moment of greater than 1.9 Debye would be considered to have a large dipole moment. Examples of suitable coating materials include acetamide (3.6 debye), urea (4.6 debye) and thiourea (4.9 debye).

Figure 2:
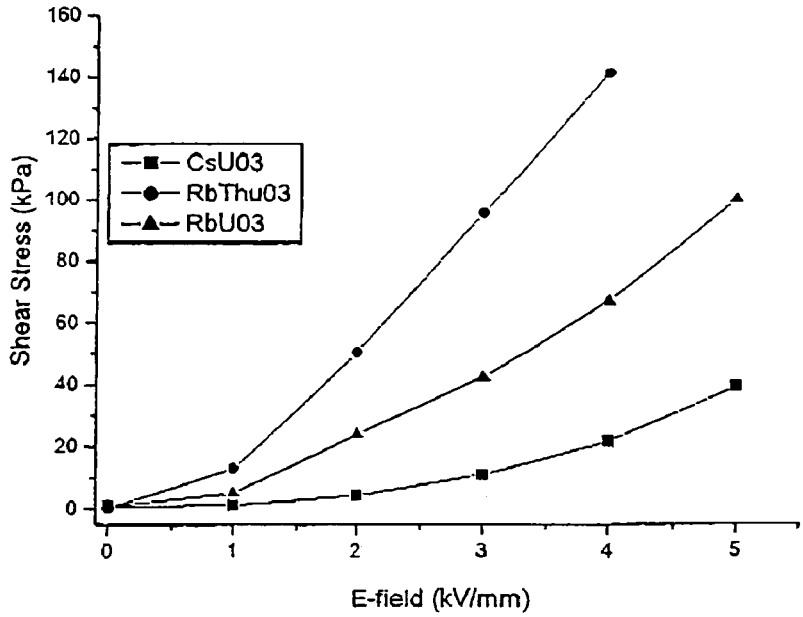
FIG. 2 shows the measured shear stress as a function of applied electric field strength using the coated particles of an embodiment of this invention and hydrocarbon oil.

FIGS. 1 and 2 show that among the three samples, $Ba_xRb_{2-2x}TiO(C_2O_4)_2$ particle coated with thiourea electrorheological fluid shows the highest yield stress compared to $Ba_xRb_{2-2x}TiO(C_2O_4)_2$ coated with urea or $Ba_xCs_{2-2x}TiO(C_2O_4)2$ coated with urea. FIG. 1 shows a silicon oil based electrorheological fluid with dispersed particles. FIG. 2 shows a hydrocarbon (HC) oil based electrorheological fluid with dispersed particles. The dispersed particles have a coated inorganic core structure which can be $Ba_xCs_{2-2x}TiO(C_2O_4)_2$ coated with urea, $Ba_xRb_{2-2x}TiO(C_2O_4)_2$ coated with urea, or $Ba_xRb_{2-2x}TiO(C_2O_4)_2$ coated with thiourea.

The high yield stress obtained by $Ba_xRb_{2-2x}TiO(C_2O_4)_2$ coated with thiourea compared with $Ba_xRb_{2-2x}TiO(C_2O_4)2$ coated with urea or $Ba_xCs_{2-2x}TiO(C_2O_4)_2$ coated with urea indicates the importance of the coating materials for the electrorheological performance. Because the molecular dipole moment of thiourea is larger than that of urea, the electrorheological effect should be much stronger. This effect is due to the aligned dipole layers at the region of contact between the coated particles being responsible for the electrorheological effect.

Figure 3:
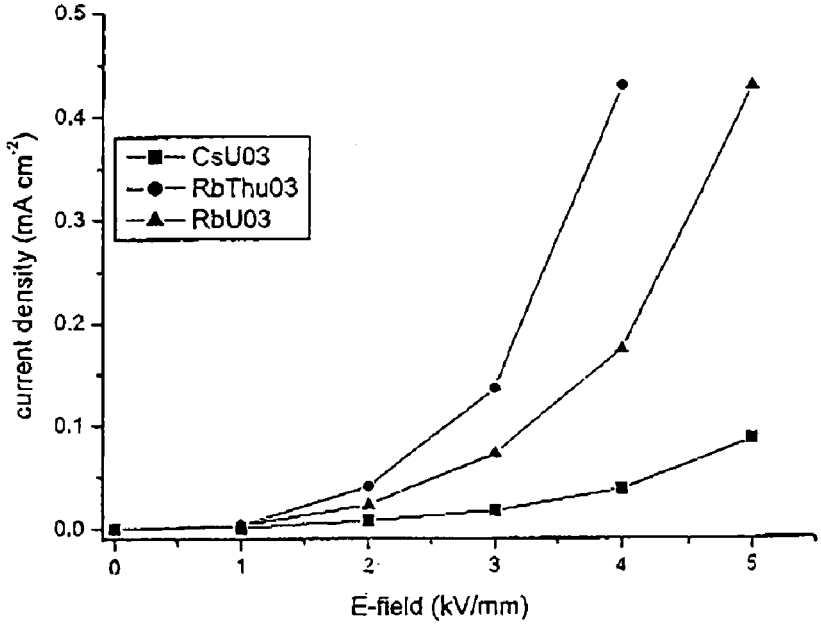
FIG. 3 shows the measured current density as a function of applied electric field strength for those samples described in FIG. 1.
Figure 4:
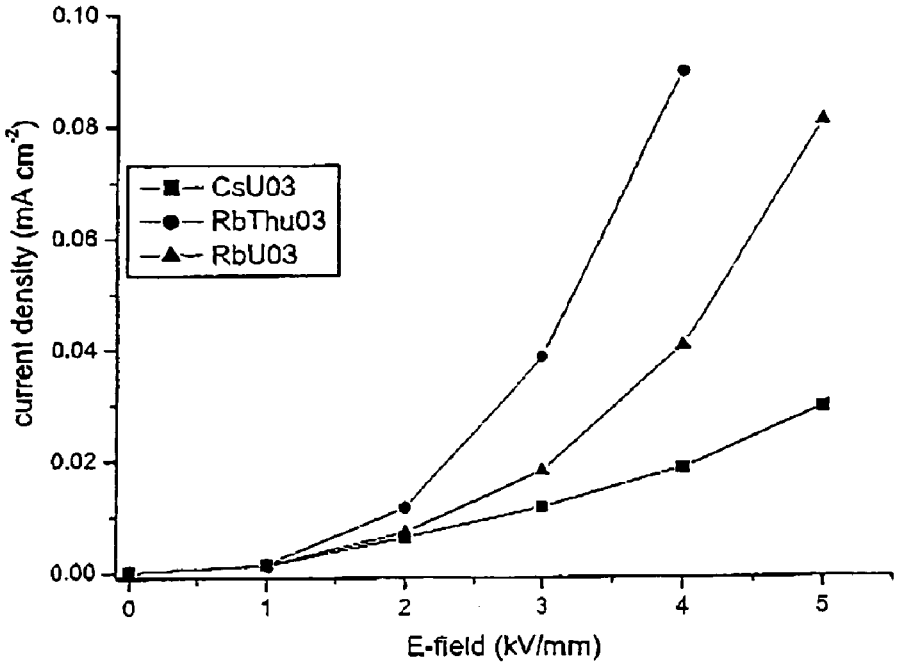
FIG. 4 shows the measured current density as a function of applied electric field strength for those samples described in FIG. 2.

The corresponding current densities for the above samples of FIGS. 1 and 2 are shown in FIG. 3 for silicone oil and FIG. 4 for hydrocarbon oils. It is clear from these figures that smaller current densities were measured when the silicone oil is replaced by hydrocarbon oil.

Figure 5:
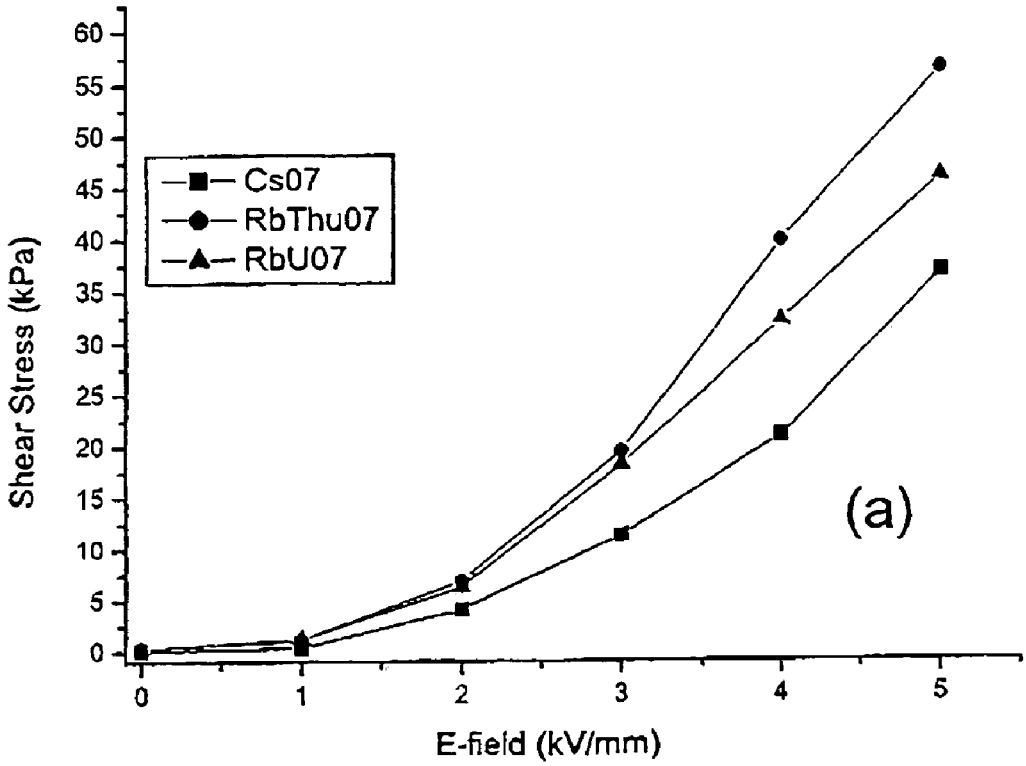
FIG. 5(*a*) shows the measured shear stress of electrorheological fluid as a function of the applied electric field strength.
Figure 5:
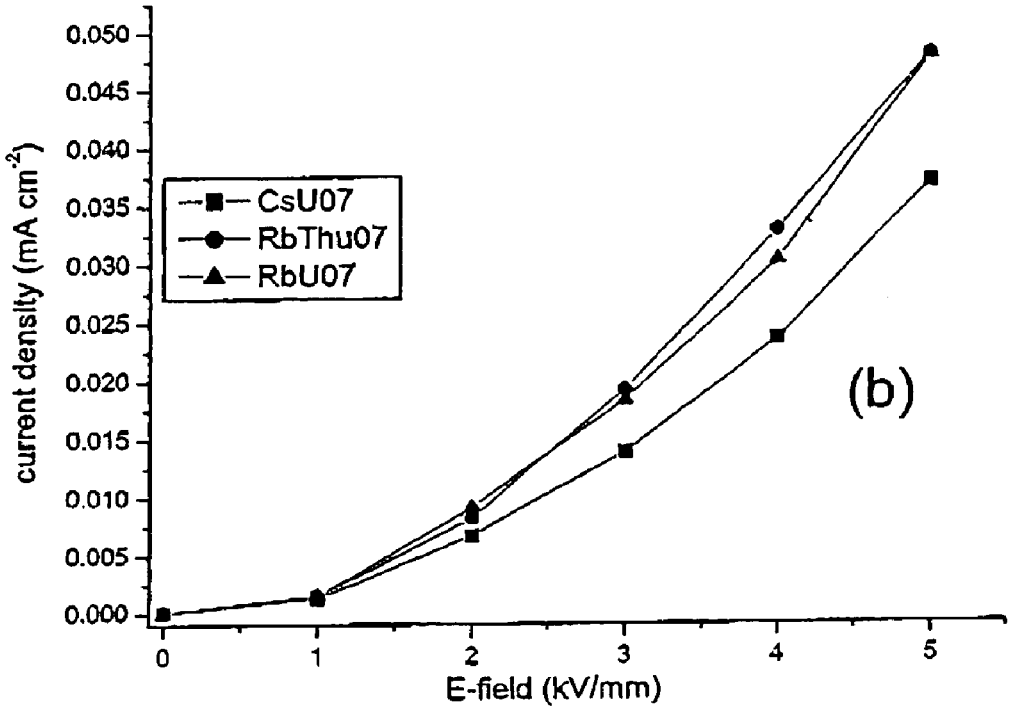
Figure 6A:
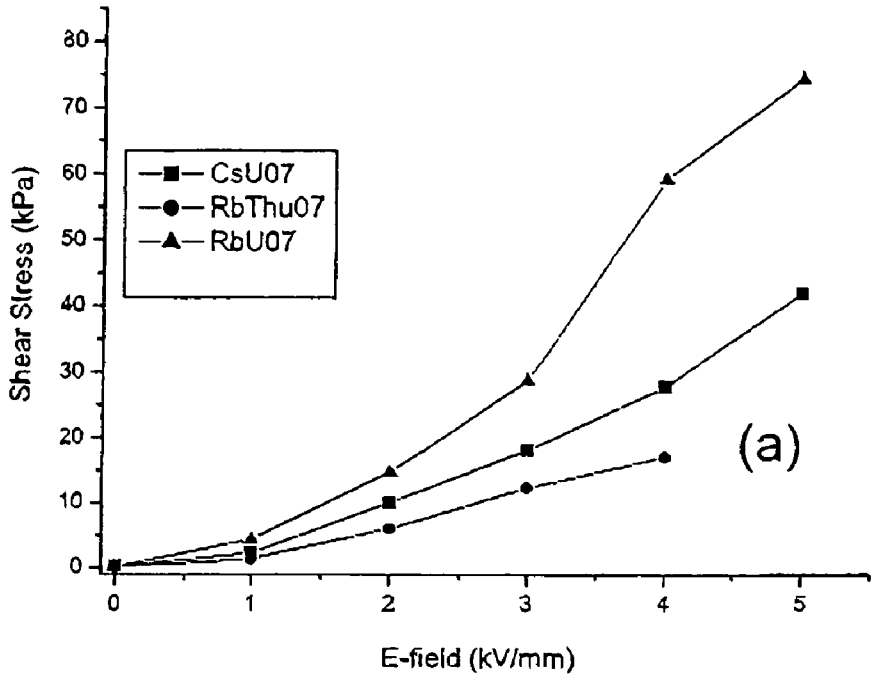
FIG. 6(*a*) shows the measured shear stress of silicone oil based electrorheological fluids as a function of the applied electric field strength.
Figure 6B:
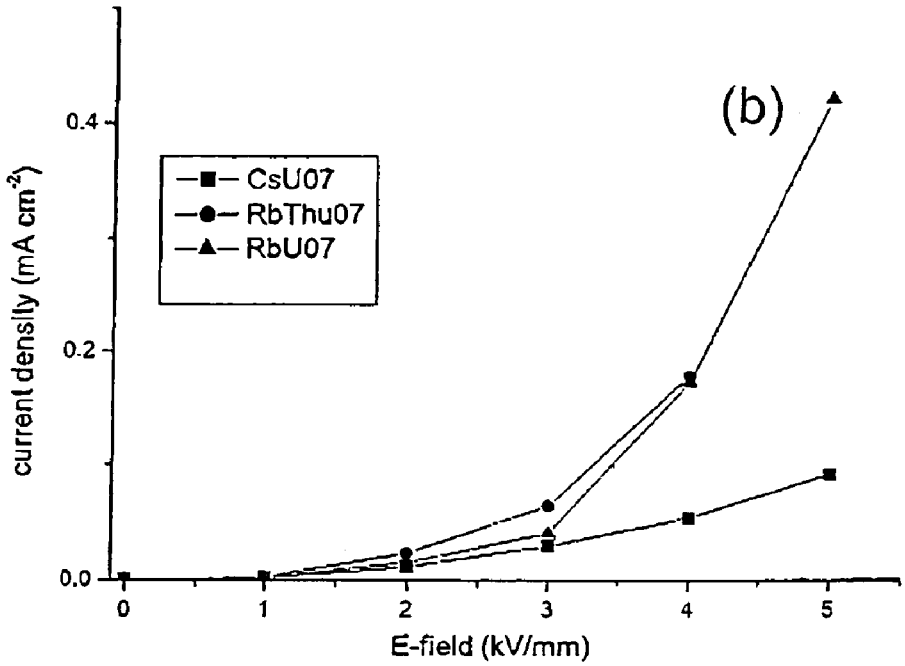

When the electrorheological fluid is diluted (from 0.3 ml to 0.7 ml of oil per gram of solid particles), the yield stress and current density for the three samples decrease accordingly, as shown in FIGS. 5(*a*) and 5(*b*). It is noted that the order of the three curves, in terms of the magnitude of the measured shear stress, has not changed. However, when silicone oil based electrorheological fluids were diluted, as can be seen in FIGS. 6(*a*) and 6(*b*), different ordering can be obtained—the BaRb $TiO(C_2O_4)_2$ coated with urea shows the highest yield stress.

Figure 7A:
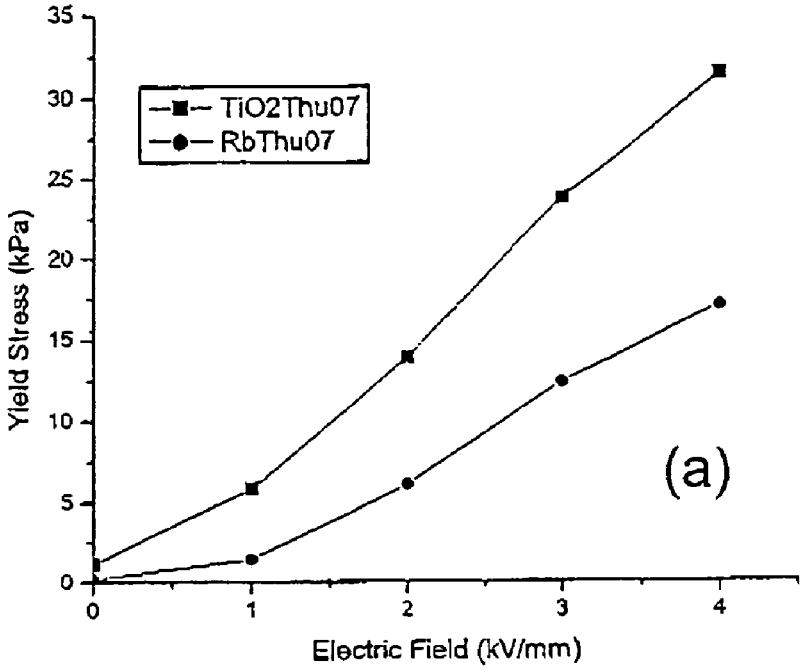
FIG. 7(*a*) shows the measured yield stress as a function of electric field strength.
Figure 7B:
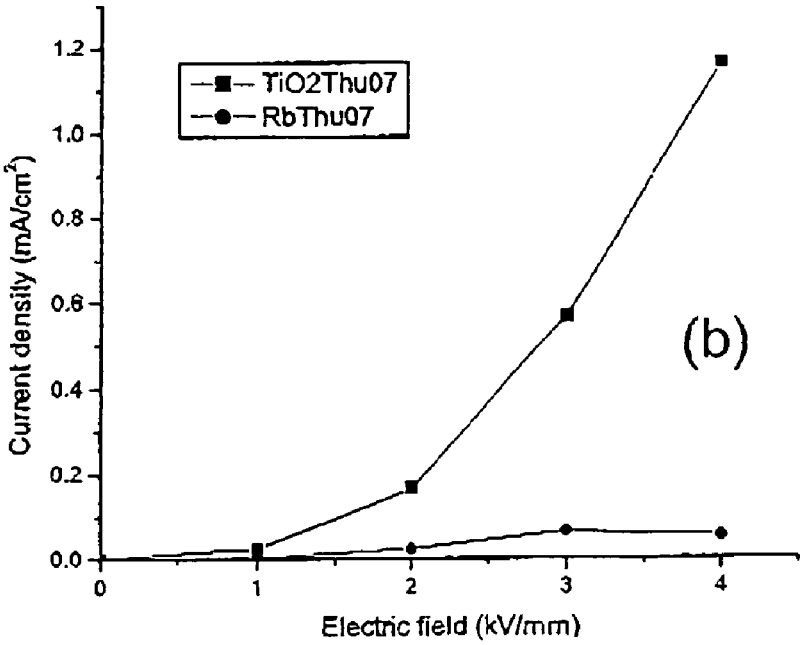

When the core materials of metal salts is replaced by $TiO_2$, while the coating material is fixed, the resulting yield stress FIG. 7(*a*) and current density FIG. 7(*b*) can be seen as a function of the applied electric field strength. It is noted that the $TiO_2$ coated with thiourea electrorheological fluids shows higher electrorheological effect, but at the cost of higher current density.

In FIGS. 7(*a*) and 7(*b*) the nanoparticles have the structure of either $TiO_2$ coated with thiourea or $Ba_xRb_{2-2x}TiO(C_2O_4)_2$ coated with thiourea. This comparison shows that the $TiO_2$ core particle can lead to larger yield stress, but at the cost of larger current density.

Figure 8A:
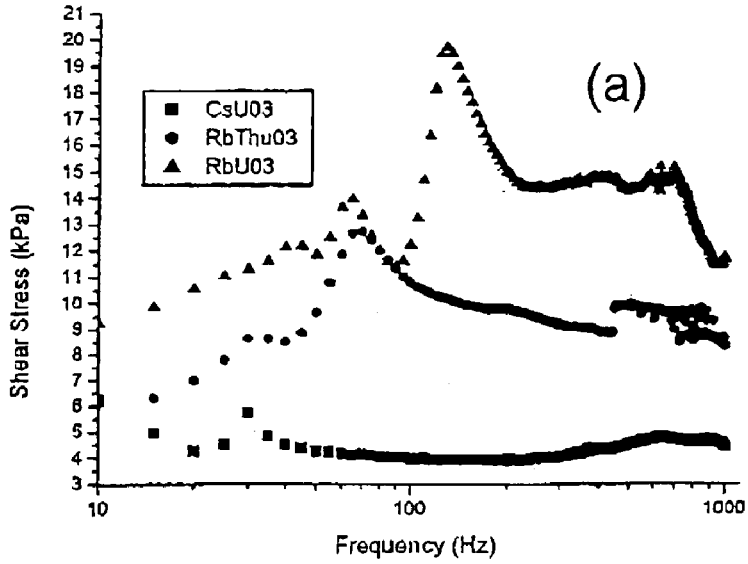
FIG. 8(*a*) shows the measured yield stress as a function of the frequency (of the applied electric field), for silicone oil based electrorheological fluids.
Figure 8B:
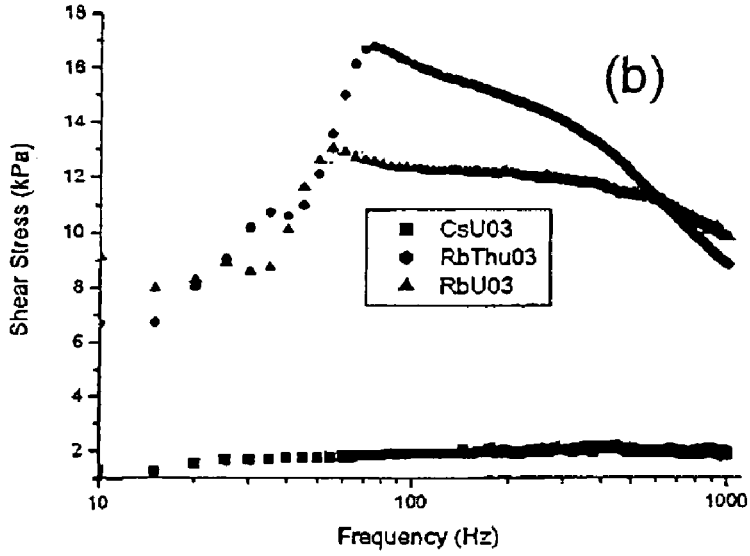

FIGS. 8(*a*) and 8(*b*) show the frequency dependencies of silicone oil (a) and hydrocarbon oil (b) based electrorheological fluids, respectively. Peaks are observed at frequencies around 100 Hz. It is noted that both electrorheological fluids still show very strong electrorheological effect even at frequencies approaching 1000 Hz.

In another embodiment of the present invention long chain polymers may be added to the electrorheological fluid. These long chain polymers are selected so that they do not materially influence the functionality of the electrorheological fluid. The addition of the long chain polymer to the electrorheological fluid increases the zero field viscosity of the fluid. In extreme cases the addition of the polymer allows the electrorheological fluid to be in a near jelly like state, thus minimizing any flow of the fluid. Suitable long chain polymers include Poly(methyl methacrylate), (PMMA).

We claim:

1. An electrorheological fluid comprising nanoparticles comprising an inorganic core comprising $TiO_2$, coated with a polar compound and an electrically insulating hydrophobic liquid.

2. An electrorheological fluid as claimed in claim 1 wherein the polar compound comprises molecules having a molecular dipole of greater than 1.9 Debye.

3. An electrorheological fluid as claimed in claim 2 wherein the polar compound is urea.

4. An electrorheological fluid as claimed in claim 2 wherein the polar compound is thiourea.

5. An electrorheological fluid as claimed in claim 1 wherein the coating comprises between 5 and 30 percent by weight of the coated nanoparticles.

6. An electrorheological fluid as claimed in claim 1 wherein the hydrophobic liquid has a volume fraction ranging from 5% to 50%.

7. An electrorheological fluid as claimed in claim 1 wherein the hydrophobic liquid has a volume fraction ranging from 10% to 35%.

8. An electrorheological fluid as claimed in claim 1 wherein the hydrophobic liquid is an oil selected from the group consisting of a silicone oil, a mineral oil, an engine oil, and a hydrocarbon oil.

9. An electrorheological fluid as claimed in claim 8 wherein the oil has a viscosity ranging from 10 to 200 cP.

10. An electrorheological fluid as claimed in claim 1 that is activated by applying a dc or ac electric field with a frequency ranging from 0.1 Hz to 10 kHz.

11. An electrorheological fluid comprising nanoparticles comprising an inorganic core coated with a polar compound and an electrically insulating hydrophobic liquid, where the core is $TiO_2$ or an amorphous salt of the form $M1_xM2_{2-2x}TiO(C_2O_4)_2$ wherein M1 is selected from the group consisting of Ba, Sr and Ca and wherein M2 is selected from the group consisting of Rb, Li, Na and K, and wherein a long chain polymer is added to preserve the yield stress at high shear rates or to prevent dripping of the electrorheological fluid.

12. An electrorheological fluid as claimed in claim 11 wherein the long chain polymer is PMMA.

* * * * *